United States Patent [19]

Engel et al.

[11] 4,265,165

[45] May 5, 1981

[54] RADIAL PISTON FLUID TRANSLATING DEVICE WITH POWER CONSERVING SCAVENGING MEANS

[75] Inventors: William K. Engel, Peoria; Dean E. Miller, East Peoria, both of Ill.

[73] Assignee: Caterpillar Tractor Co., Peoria, Ill.

[21] Appl. No.: 90,153

[22] Filed: Aug. 27, 1979

[51] Int. Cl.[3] ..... F01B 13/06

[52] U.S. Cl. ..... 91/490

[58] Field of Search ..... 91/490, 485, 486, 497, 91/491

[56] References Cited

U.S. PATENT DOCUMENTS

| | | | |
|---|---|---|---|
| 3,433,124 | 3/1969 | Parrett | 91/501 |
| 3,461,809 | 8/1969 | Budecker | 417/269 |
| 3,530,768 | 9/1970 | Engel | 91/491 |
| 3,742,818 | 8/1973 | Engel | 91/491 |
| 3,802,321 | 4/1974 | Bosch | 91/485 |
| 4,048,907 | 9/1977 | Engel | 91/498 |
| 4,148,249 | 4/1979 | Jacobs | 91/485 |

FOREIGN PATENT DOCUMENTS

| | | | |
|---|---|---|---|
| 1476686 | 6/1977 | United Kingdom | 91/491 |

*Primary Examiner*—William L. Freeh

*Attorney, Agent, or Firm*—Phillips, Moore, Weissenberger, Lempio & Majestic

[57] ABSTRACT

In a pump or fluid motor (11, 11*a*, 11*b*) having a closed chamber (57) in which cylinders (38) orbit and reciprocate, leakage and cooling fluid which accumulates in the chamber (57) is formed into a rotating annular volume by centrifugal effects and exhibits a higher pressure in the region where the cylinders (38) move radially inward and closer together than in the opposite region where the cylinders (38) move outward and further apart. Power wastage from drag torque, turbulence and heat generation is reduced by scavenging the accumulated fluid from the chamber (57). Internal recirculation of the scavenged fluid from the high pressure portion of the annular rotating volume back to the low pressure portion is avoided by communicating the drain passages (68, 68*a*, 68*b*) with only a limited relatively high pressure sector of the rotating volume of fluid.

11 Claims, 4 Drawing Figures

RADIAL PISTON FLUID TRANSLATING DEVICE WITH POWER CONSERVING SCAVENGING MEANS

TECHNICAL FIELD

This invention relates to the scavenging of leakage or cooling fluid from pumps and fluid motors of the form having cylinders which reciprocate radially while orbiting in a circular path.

BACKGROUND ART

Radial piston fluid translating devices, including pumps and motors and devices which may function interchangeably as a pump or as a motor, often have a closed case in which a plurality of cylinders are disposed on piston spokes that extend radially from a rotor. The cylinders orbit within an eccentrically positioned race that forces radial reciprocation of the cylinders as the rotor turns.

In some devices of this kind the race or adjacent structure forms an annular chamber at the cylinder orbit which tends to accumulate leakage fluid. In some cases the device may include means for deliberately admitting a small flow of fluid into the cylinder orbit chamber for cooling and lubrication purposes. During operation, centrifugal force tends to trap a rotating volume of the fluid in the cylinder orbit chamber unless drainage or scavenging means are provided to remove such fluid.

If a sizable volume of leakage or cooling fluid remains trapped in the cylinder orbit chamber during operation, serious power wastages occur from increased drag torque or resistance to cylinder motion, from turbulence and from increased frictional heating of the fluid. Increased heating in turn requires higher cooling capacity. Aeration problems are also aggravated in systems where the leakage or cooling fluid, typically oil, is recovered and eventually recirculated through the device as working fluid.

These problems can be reduced by providing scavenging means for expelling fluid from the cylinder orbit chamber. While this is a relatively simple matter in some pump or motor configurations, complications are encountered in many others, most notably in devices designed to operate with a high working fluid pressure or at high rotational speeds or under both conditions.

One complication arises from the centrifugal force effect which acts to hold fluid in the annular chamber formed by the race or associated structure. Simple gravity drain passages are thus ineffective. In addition, the race and associated elements which define the cylinder orbit chamber in some devices are themselves rotatable and, to provide for displacement changes, are also translatable. Thus such elements do not offer fixed locations for drain passages.

At first consideration, it might appear that scavenging could be accomplished by providing a series of drain passages around the circumference of the cylinder orbit chamber to allow centrifugal force to expel fluid into a drainage collector channel. We have found that, at least in some forms of pump or motor, this does not provide a fully satisfactory scavenging action. Power losses remain high and the other adverse effects discussed above are still encountered to an unexpected degree. The prior art does not provide a truly efficient centrifugal scavenging means for radial piston fluid translating devices of the general type identified above.

DISCLOSURE OF INVENTION

The present invention is directed to overcoming one or more of the problems as set forth above.

In one aspect of this invention a radial piston fluid translating device has a rotor, a plurality of fluid translating elements carried on the rotor, race means for forcing radial reciprocation of the elements as the rotor turns and which defines an annular chamber in which the elements orbit and in which centrifugal force forms accumulated fluid into a rotating annular volume during rotation of said rotor and in which different portions of the rotating annular volume of fluid exhibit different pressures. Efficient centrifugal scavenging of fluid from the orbit chamber is provided for by scavenging means which communicate the chamber with a drain path along a first portion of the element orbit at which the fluid exhibits a first pressure while blocking communication between the chamber and the drain path at a second portion of the orbit at which the fluid exhibits a different second pressure.

In another aspect of the invention in which the means forming the fluid translating element orbit chamber is selectively shiftable in a direction orthogonal to the rotor axis to either side of a zero displacement position to vary displacement and direction of operation of the device, first discharge collector means are provided at one sector of the element orbit and second discharge collector means are provided at an opposite sector of the element orbit. Discharge control means communicates the first discharge collector means with the drain path while isolating the second discharge collector means therefrom when the race is shifted in a first direction and communicate the second discharge collector means with the drain path while isolating the first discharge collector means therefrom when the race is shifted in the opposite direction.

The invention avoids a form of power wastage from internal recirculation of fluid which we have found to be otherwise present in centrifugally scavenged devices where the fluid translating element orbit chamber is communicated with a drain path around the entire circumference of the chamber or at intervals around the entire circumference of the chamber.

We have ascertained that the fluid pressure within the centrifugally trapped annular volume of fluid is not uniform around the fluid translating element orbit. Pressure is relatively low at the sector of the orbit where elements move radially outward and therefore further apart while being relatively high at the opposite orbit sector where the elements move inward and thus closer together. The relatively high pressure at the latter portion of the orbit is in part a direct result of the squeezing action of the converging elements and in part an indirect result of the increased radial thickness of the squeezed fluid between converging elements which thickness amplifies the pressure generating effect of centrifugal force.

Because of this pressure differential between two different sectors of the fluid translating element orbit, simultaneous communication of both sectors of the orbit chamber with a leakage fluid drain interferes with the desired scavenging action. A substantial portion of the fluid expelled from the high pressure sector of the orbit chamber recirculates back to the lower pressure sector within the drain path rather than passing immediately to the drainage outlet. This internal recirculation, accompanied by turbulence and increased heating in the fluid is a significant source of power loss and aggravates the other problems hereinbefore discussed.

The present invention avoids this power loss and reduces related problems by providing scavenging means which at any given time communicates the drain path with only a predetermined portion of the fluid translating element orbit chamber so that internal recirculation of fluid between that portion and another portion of substantially different pressure is avoided.

BEST MODES FOR CARRYING OUT THE INVENTION

Figure 1:
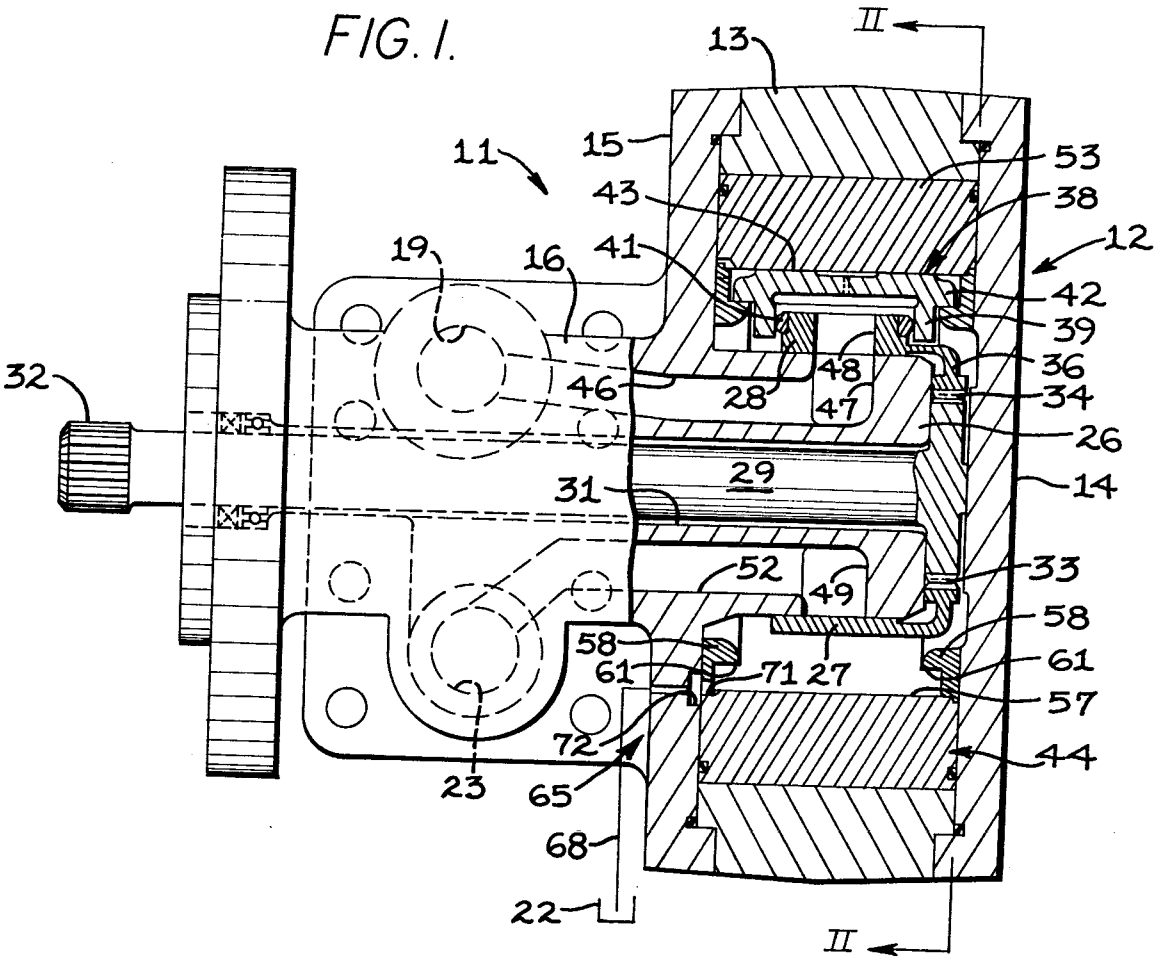
FIG. 1 is a broken-out view of a variable displacement fluid translating device having scavenging means in accordance with a first embodiment of the invention and which is operable as either a pump or motor under conditions where fluid flow and rotor rotation are always in the same directions.
Figure 2:
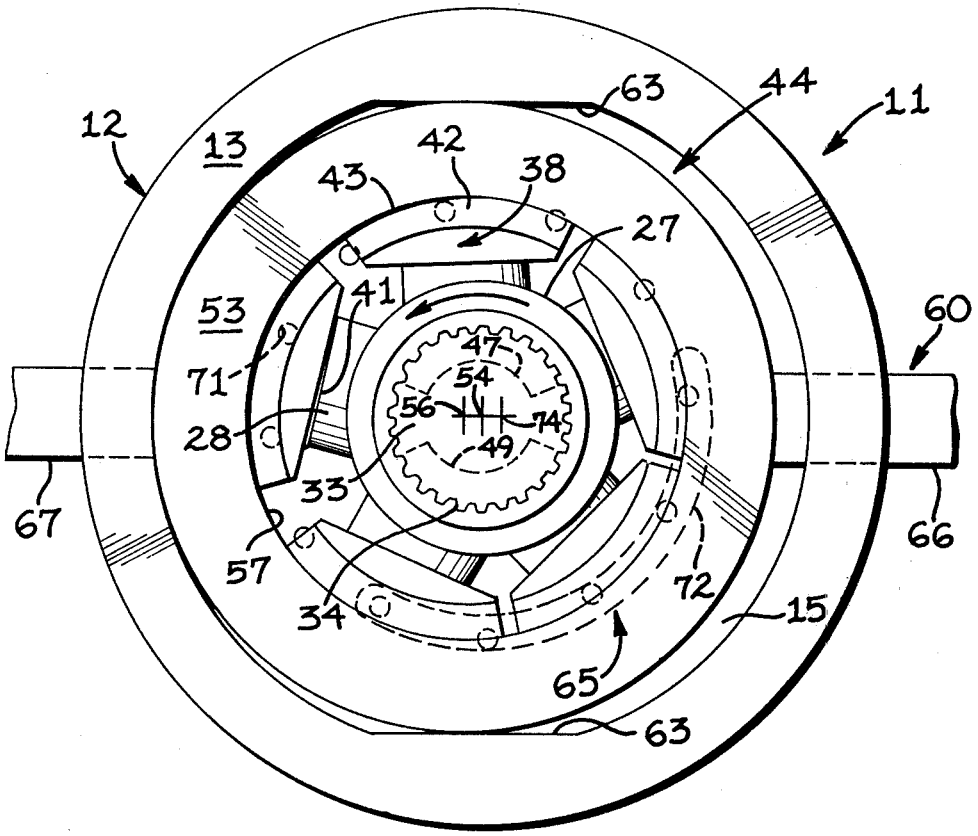
FIG. 2 is a cross section view of the apparatus of FIG. 1 taken along line II—II thereof.

Referring initially to FIGS. 1 and 2 of the drawings in conjunction, a fluid translating device 11 is provided with housing means 12 which in this example includes an annular case member 13 secured between a circular end plate 14 and a circular flange 15 of a primary housing member 16. The primary housing member 16 includes first and second working fluid ports 19 and 23 for receiving and discharging fluid which is translated through the device 11.

To support rotatable components of the device 11, a cylindrical pintle 26 extends from the center region of flange 15 towards end plate 14 within annular case member 13, the pintle 26 being an integral portion of the primary housing member 16 in this example.

An annular rotor 27 is disposed on pintle 26, for rotation about the axis of the pintle and case member 13, and has radially extending piston spokes 28 of which there are five in this particular example and which are equiangularly spaced around the axis of the rotor.

Rotor 27 is coupled to a drive shaft 29 which is disposed at the rotary axis of the device 11 within a bore 31 which extends through the primary housing member 16 including pintle 26. An inner end of the drive shaft 29 abuts end plate 14 while the outer end of the shaft extends from primary housing member 16 a short distance and has splines 32 to provide for coupling of a drive motor or the like to the device 11 when it is operated as a pump or to couple the device to a driven load when it is operated as a motor. Shaft 29 is coupled to rotor 27 through a gear 33 formed on the interior end of the drive shaft between pintle 26 and end plate 14. Gear 33 engages teeth 34 on a portion 36 of the rotor which extends radially inwardly between pintle 26 and end plate 14.

Each piston spoke 28 carries a radially reciprocable fluid translating element 38, which in this example are cylinders 38 that orbit around the axis of the pintle 26 and rotor 27 as the rotor turns. Each cylinder 38 has a cylindrical sleeve portion 39 in which the outer end of the associated piston spoke 28 is received. Cylinders 38 have an inside diameter slightly greater than the outer diameter of the piston spokes 28 and an annular seal ring 41 is mounted on the end of each piston spoke and has a rounded outer surface which contacts the inner surface of the associated cylinder, the seal rings 41 serving to inhibit fluid leakage while enabling a rocking or tilting movement of the cylinder relative to the axis of the piston spoke. The radially outermost ends of sleeve portions 39 of the cylinders are closed by shoe portions 42 which, as best seen in FIG. 2 in particular, have arcuate outer surfaces 43 conforming in curvature with the inner surface of an annular race means 44 which will hereinafter be described in more detail.

Referring again to FIG. 1 in conjunction with FIG. 2, to communicate first working fluid port 19 with each cylinder as the cylinder travels through a first portion of its orbit, an angled passage 46 extends from port 19 through the primary housing member 16 and into pintle 26 to an arcuate groove 47 formed in the pintle. Groove 47 is limited to a portion of the piston and cylinder orbit lying on one side only of the diameter along which race means 44 is translated to change displacement, and is positioned to communicate with the internal radially extending passages 48 of the piston spokes 28 as the piston spokes turn through that portion of the orbit. Another angled passage 52 in primary housing member 16 connects second working fluid port 23 with another arcuate groove 49 located on pintle 26 to communicate with the internal passages 48 of the piston spokes during movement of the piston spokes through the opposite sector of the orbit.

To define an eccentric cylinder orbit in order to force radial reciprocation of the cylinders 38, race means 44 includes an annular race 53 encircling rotor 27 with the arcuate outer surfaces of shoe portions 42 of the cylinders being abutted against the inner surface of the race. Race 53 has an outer diameter smaller than the inner diameter of case member 13 to enable selective shifting of the race in a direction orthogonal to the rotational axis 54 of the drive shaft 29 and rotor 27. Race 53 may be shifted between a zero displacement position at which the axis 56 of the race is coincident with rotational axis 54 and a maximum displacement position at which the axis 56 of the race is displaced to one side of pump axis 54 thereby causing the cylinder orbit to be eccentric relative to the rotor. Radial reciprocation of the cylinders does not occur at the zero displacement position but becomes progressively greater as race 53 is shifted towards the maximum displacement position.

While the particular device 11 depicted in FIGS. 1 and 2 is operated as a nonovercenter pump or motor in which race 53 is shifted away from the zero displacement position in only one direction, the race is capable of being shifted in the opposite direction as well and an example of the adaptation of the device to such overcenter operation will hereinafter be described.

To constrain the cylinders 38 to ride against the inner surface of race 53, within the cylinder orbit chamber 57, one of a pair of annular race members 58 extends radially inward from the side of race 53 which is adjacent flange 15 and the other race member 58 similarly extends inward at the opposite side of race 53 adjacent end plate 14. Cylinders 38 are held against the inner surface of race 53 as the shoe portion 42 of each cylinder extends a small distance outward from the cylinder sleeve portion 39 at opposite sides of the cylinder into annular track grooves 61 formed by the race members 58.

To support the race 53, which is free to rotate, while enabling linear movement of the race 53 in a direction orthogonal to the rotational axis 54, the inner surface of annular case member 13 is formed with flat sections 63 which extend parallel to the plane defined by the pump rotational axis 54 and the maximum displacement position rotational axis 56 of the race means and which are spaced apart by a distance equal to the outer diameter of race 53. Movement of race 53 in a direction parallel to flat sections 63 is accomplished with displacement control means 60 which in this example includes displacement control rods 66 and 67 that extend through opposite sides of case member 13 to contact opposite sides of the outer surface of race 53, the control rods 66 and 67 being aligned along a direction which is orthogonal to the rotational axis 54 of the pump and which lies in the plane defined by rotational axis 54 and the maximum displacement axis 56 of the race. Thus through axial movement of the control rods 66 and 67, utilizing any of the suitable displacement control linkages known to the art, the race 53 may be moved laterally by sliding motion along surfaces 63 from the zero displacement position towards the maximum displacement position to adjust and control the volume of fluid which is translated per revolution of rotor 27.

Considering now scavenging means 65 for releasing fluid which accumulates in the cylinder orbit chamber 57 from leakage and which in some cases is deliberately admitted for cooling purposes, the device 11 has a fluid drain path 68 which in the present example is communicated with the working fluid reservoir 22. Return of drainage fluid to the reservoir 22 is often preferable, particularly in large high speed pumps or motors, since such fluid tends to be undesirably hot and aerated. In instances where these conditions are not found to an undesirable degree, the drain path 68 may be communicated with the one of the working fluid ports 19 or 23 at which fluid pressure is low, rather than to the reservoir.

Fluid which accumulates in cylinder orbit chamber 57 during operation is formed into a rotating annular volume by centrifugal force and exhibits a substantial fluid pressure as a result of such force. To release such fluid into drain path 68, a series of discharge passages 71 are provided in the one of the race members 58 which is adjacent flange 15. Discharge passages 71 extend from the track groove 61 to the opposite face of the race member 58 which contacts flange 15, the discharge passages being situated at equal angular intervals around the axis of race member 58, twelve such discharge passages being provided in this example.

To collect fluid which is expelled from chamber 57 through the discharge passages 71 of the race member 58, an arcuate collector groove 72 is provided at the inner surface of flange 15 of the primary housing member 16 and is communicated with the drain path 68. As best seen in FIG. 2 in particular, collector groove 72 is restricted in length to less than a one-half sector of the cylinder orbit and in particular to a portion of the orbit at which the cylinders 38 move radially inward and therefore closer together as the rotor turns, the direction of rotor rotation in this example as viewed in FIG. 2 being counterclockwise. The bottom dead center position at which the cylinders 38 reach their radially outermost position occurs when the cylinders are closest to the left control rod 67 of FIG. 2 and the top dead center position at which the cylinders are at the radially inner most position occurs when the cylinders are closest to the opposite control rod 66. Collector groove 72 in this example begins at a point in the cylinder orbit which is beyond the bottom dead center position and terminates at a point slightly past the top dead center position as the amount of cylinder convergence is relatively small for an interval after the cylinders 38 pass the bottom dead center position but reaches a maximum at the top dead center position. Thus collector groove 72 is confined to the region of the cylinder orbit at which drainage fluid pressure is high, relative to other portions of the orbit due to the squeezing effect of the converging cylinders 38.

To assure that the discharge passages 71 communicate with the collector groove 72 as the passages turn through the predetermined portion of the orbit at which the cylinders move closer together, although the center of the race means 44 may be shifted to various positions between the drive shaft rotational axis 54 and the maximum displacement position 56, the collector groove has a width measured along a radius of the race means at least equal to the distance between the drive shaft rotational axis 54 and the maximum displacement center 56 of the race means.

The leakage fluid scavenging means 65 as described above with reference to FIGS. 1 and 2 is designed to accommodate to operations of the device 11 as a pump or motor under conditions where the flow of working fluid is always in the same direction, specifically where fluid enters first port 19 and is discharged through second port 23, where drive shaft 29 always turns in the same direction and where displacement changes are confined to movement of the race 53 to one side only of the drive shaft rotational axis 54. Under these conditions, the sector of the cylinder orbit at which cylinders 38 move radially inward is always the same sector and a single collector groove 72 at the previously described location is sufficient to achieve the objectives of the invention. The device 11 depicted in FIGS. 1 and 2 is also adaptable to usages where the direction of the flow of working fluid may be reversed, where the drive shaft 29 rotation may be reversible, where overcenter displacement changes may be made or where combinations of these modes of operation are desired. Various modifications of the scavenging means 65 may be made to adapt the device 11 for such purposes, two examples being illustrated in FIGS. 3 and 4.

Figure 3:
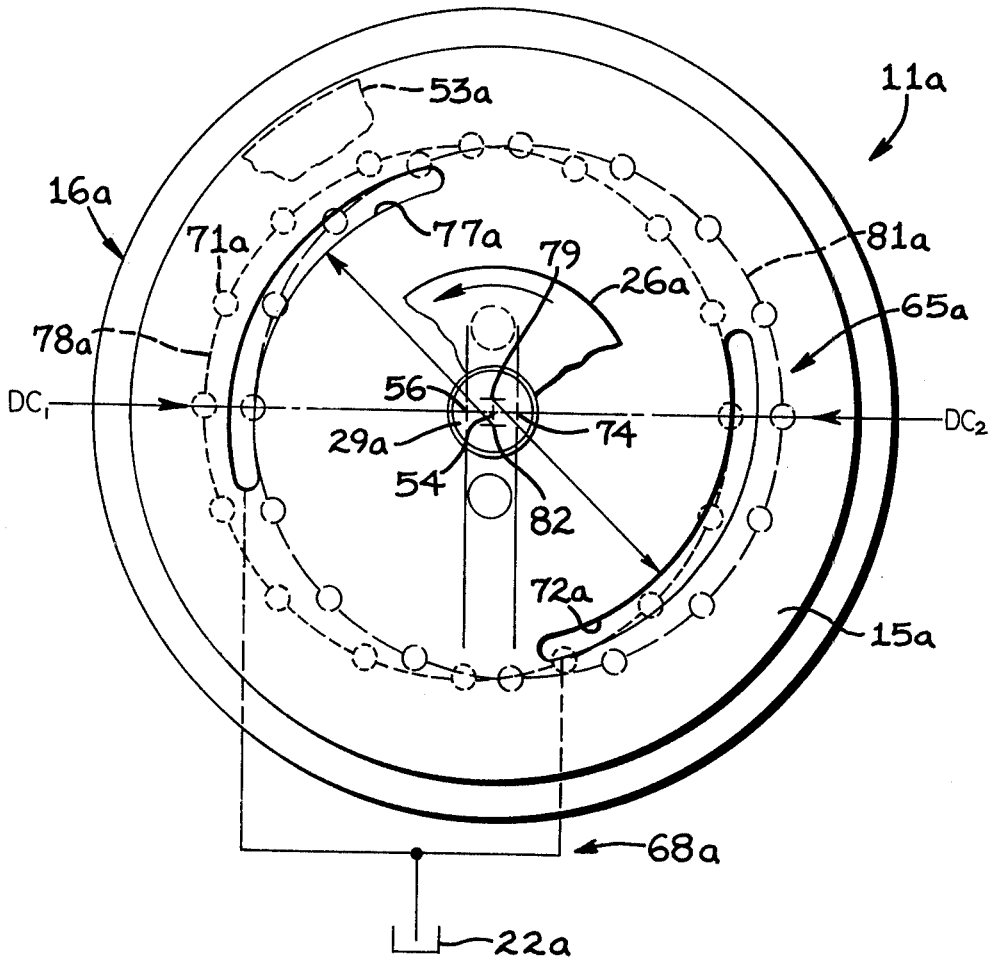
FIG. 3 illustrates a modification of the scavenging means which adapts the device, otherwise similar to that of FIGS. 1 and 2, to operation as a pump in which rotor rotation is always in the same direction but in which fluid flow direction may be reversed.

FIG. 3 depicts a modification of the scavenging means **65*a* which enables operation of the device 11*a* as a pump under conditions where drive shaft 29*a* is always turned in the same direction but in which the direction of working fluid flow is reversible by overcenter displacement changes. In particular, with reference again to FIG. 2, the basic construction of the device 11 as previously described enables a shift of race 53 towards a second maximum displacement center 74 located at the opposite side of rotational axis 54 from the previously described first displacement center 56. If the device 11 is shifted overcenter in this manner, than a reversal of the cylinder reciprocation motion at the two sectors of the cylinder orbit occurs. Radially inward motion of the cylinders 38 then occurs at the upper half of the orbit as viewed in FIG. 2 instead of at the lower half of the orbit as previously described. As it is desired that the discharge of accumulated fluid from the cylinder orbit region be confined to a portion of the orbit in which the cylinders converge, this overcenter operation requires modification of the collector groove 72 means to accommodate to the fact that discharge of accumulated fluid should occur at one portion of the orbit when the race 53 is shifted in one direction from the zero displacement position and at a different portion of the orbit when the race is shifted in an opposite direction from the zero displacement position. FIG. 3, which is a view of the inside surface of a modified primary housing member 16***a* illustrates the modifications to the scavenging means 65*a* which accommodate to the overcenter mode of operation described above. The device 11*a* of FIG. 3 may be similar to that previously described with reference to FIGS. 1 and 2 in all structural respects except for a modified arrangement of collector grooves 72*a* and 77*a* as depicted in FIG. 3.

The modified scavenging means 65*a* of FIG. 3 includes a first collector groove 72*a* in the inner surface of flange 15*a* along a first portion of the cylinder orbit and a second separate collector groove 77*a* formed in the flange surface along an opposite sector of the orbit, both such collector grooves being communicated with the working fluid reservoir 22*a* through a branched drain path 68*a*.

In FIG. 3, dashed circle 78*a* corresponds to the cylinder orbit and depicts the location of the discharge passages 71*a* of the race 53*a* at a time when the race is shifted to be centered on the first maximum displacement center 56. Under that displacement condition, the arrow designated $DC_1$ in FIG. 3 identifies the bottom dead center point on the orbit while arrow $DC_2$ identifies the top dead center point. The first collector groove 72*a* is located on flange 15*a* along a portion of the orbit 78*a* which begins slightly more than halfway from dead center position $DC_1$ to the other dead center position $DC_2$ and which extends a small distance past dead center $DC_2$. The first collector groove 72*a* has a width, measured along a radius of device 11*a*, which provides for communicating the collector groove with those of the discharge passages 71*a* which are situated along that portion of the orbit only when the race 53*a* is in the vicinity of the zero displacement position or shifted towards the first displacement center 56, the discharge passages 71*a* being out of communication with first collector groove 72*a* when the race 53*a* is shifted significantly away from the zero displacement position towards the other maximum displacement center 74. This configuration and location for the first collector groove 72*a* may be realized by forming that collector groove as an arc of a circle having a center of curvature of 79 which is equidistant from the two displacement centers 56 and 74 and spaced from the rotational axis 54 of drive shaft 29*a* by about one-half the spacing of the displacement centers 56 and 74 therefrom, the width of the first collector groove 72*a* being slightly less than the spacing of either of the maximum displacement centers 56 or 74 from the rotational axis 54.

Dashed circle 81*a* in FIG. 3 indicates the position of the cylinder orbit and also the positions of the discharge passages 71*a* when the race 53*a* has been shifted in the opposite direction to be centered on the second maximum displacement center 74. Under this condition, the point designated in FIG. 3 by arrow $DC_1$ becomes the top dead center position at which cylinder convergence is at a maximum while the opposite point designated by arrow $DC_2$ becomes the bottom dead center position at which the cylinders are most widely spaced apart. Thus under this condition the position along the orbit at which accumulated fluid pressure is highest and from which it is desired to discharge such fluid is diametrically reversed relative to the original condition described above. To provide for such release of fluid under this alternate displacement condition, the second collector groove 77*a* is formed in flange 15*a* along a portion of the shifted orbit position 81*a* which begins slightly more than halfway from dead center position $DC_2$ to dead center position $DC_1$ and which extends a small distance past dead center position $DC_1$. In order to receive discharge fluid from the discharge passages 71*a* situated at that portion of the shifted cylinder orbit 81*a*, the second collector groove 77*a* may have a configuration and width similar to that previously described for first collector groove 72*a* and may be a circular arc having a center of curvature 82 situated on the opposite side of rotational axis 54 from center of curvature 79.

Figure 4:
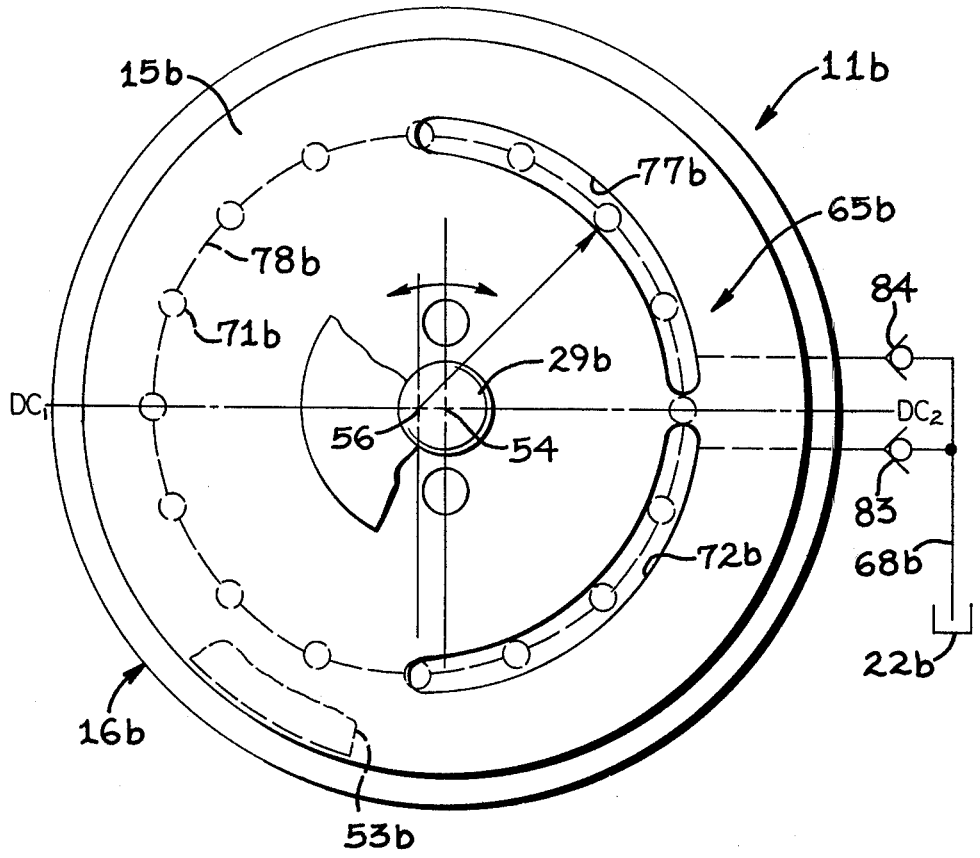
FIG. 4 illustrates a further modification of the scavenging means which adapts to the device, otherwise similar to that of FIGS. 1 and 2, to operation as a pump in which flow direction may be reversed by reversing rotor direction or as a motor in which the rotational direction of the rotor motion may be reversed by reversing fluid flow.

FIG. 4 depicts still another modification of the scavenging means 65*b* which adapts a device 11*b*, otherwise similar to those previously described, for operation as either a pump or a motor under conditions where both the direction of flow of working fluid and the direction of rotation of drive shaft 29*b* may be reversed but in which displacement changes are in one direction only, specifically between a zero displacement position at which the race 53*b* is centered on the rotational axis 54 of the drive shaft and the first maximum displacement center 56. FIG. 4 again depicts only the inner surface of a modified primary housing member 16*b* showing the modified scavenging means 65*b* as the device 11*b* may otherwise be structurally identical to the previously described device 11 of FIGS. 1 and 2.

If, in the device 11*b* of FIG. 4, the direction of flow of working fluid and the direction of rotation of drive shaft 29*b* are the same as in the unidirectional device previously described with respect to FIGS. 1 and 2, then the zone of maximum cylinder convergence in the device 11*b* of FIG. 4 is the same as in the previous case and accordingly a first arcuate collector groove 72*b* is provided in the inner surface of flange 15*b* along the portion of the cylinder orbit, indicated by dashed circle 78*b*, which extends from a point about midway from the bottom dead center position $DC_1$ to a point on the orbit which preceeds the top dead center position $DC_2$ by a distance just slightly greater than the radius of the discharge passages 71*b* of race 53*b*. First collector groove 72*b* is communicated with the fluid reservoir 22*b* through a check valve 83 and drain path 68*b*, the check valve being oriented to allow only flow from the collector groove to the drain path 68*b* while blocking flow in the opposite direction.

If, when the device 11*b* is being operated as a motor, the flow of working fluid is reversed by external control means then the direction of rotation of the rotary components of the device also reverses. Consequently, the zone of cylinder convergence then shifts to the other side of the top dead center position $DC_2$, the top sector of orbit 78*b* as viewed in FIG. 4, and the maximum rate of convergence occurs as the cylinders approach the point $DC_2$ after passing point $DC_1$. This same change of the zone of maximum cylinder convergence occurs when the device 11*b* is being operated as a pump and the direction of rotation of the drive shaft 29*b* is reversed for the purpose of reversing the direction of fluid flow through the device.

To provide for scavenging of drainage fluid under this reversed flow, reversed shaft rotation condition, a second arcuate collector groove 77*b* is provided in the inner surface of flange 15*b* along the portion of the orbit 78*b* at which the maximum cylinder convergence now occurs. In particular, the second collector groove 77*b* begins at a point on the orbit 78*b* slightly prior to the midpoint between the bottom dead center position $DC_1$ and the top dead center position $DC_2$ and terminates a small distance from the top dead center point $DC_2$ which distance is slightly greater than a radius of one of the discharge passages 71*b*. Spacing of the adjacent ends of the two collector grooves 72*b* and 77*b* from the top dead center point $DC_2$ by distances each at least equal to a radius of the discharge passages 71*b* prevents a direct exchange of fluid between the two collector grooves at times when one of the discharge passages is passing through the dead center point $DC_2$.

Second collector groove 77*b* is communicated with the drain path 68*b* to reservoir 22*b* through a second check valve 84 oriented to enable flow from the second collector groove to drain path 68*b* while blocking reverse flow. The check valves 83 and 84 thus allow fluid from either collector groove 72*b* or 77*b* to discharge into drain path 68*b* while assuring that the discharge from the one of the grooves which is at high pressure at any given time, due to cylinder convergence in the adjacent region, is not recirculated back to the other one of the grooves which at that time is at a lower pressure because of cylinder divergence.

Industrial Applicability

In the operation of the device 11 depicted in FIGS. 1 and 2 as a pump, the device may be driven by coupling a suitable motor to drive shaft 29 through spline teeth 32. First port 19 constitutes the inlet port and is communicated with the source of fluid which is to be pressurized. Second port 23 constitutes the outlet port and is communicated with a system which requires pressurized fluid. While the device 11 is adaptable to many other usages, this particular example was designed to serve as an implement pump to supply pressurized fluid to the fluid actuators and motors used on earthmoving vehicles.

Rotation of the drive shaft 29 turns rotor 27 through gear 33 and, if the race 53 has been shifted away from the zero displacement position, this forces radial reciprocation of cylinders 38 because of the eccentric relationship of the inner surface of the race relative to the rotational axis of the rotor 27. The rotor 27 and cylinders 38 are turned counterclockwise as viewed in FIG. 2 and thus the cylinders move radially outward from the rotor while traveling along the upper one half of the cylinder orbit in this example. Consequently, working fluid from inlet groove 47 is drawn into each cylinder 38 through the associated piston spoke 28 during this portion of the orbital motion of the cylinder. During travel along the bottom sector of the orbit as viewed in FIG. 2, the inner surface of the eccentrically positioned race 53 forces the cylinders 38 to move radially inward and to discharge such fluid under pressure into outlet groove 49. The amount of fluid translated from the inlet groove 47 to the outlet groove 49 during each revolution of the rotor 27 is a function of the degree of eccentricity of the cylinder orbit relative to the rotational axis 54 of the rotor and thus is selectable by shifting the race means 44 at right angles to the rotational axis through axial movement of the control rods 66 and 67.

Leakage and cooling fluid which accumulates in the cylinder orbit chamber 57 is forced into rotation by the rotary motion of the cylinders 38 and race means 44. Centrifugal force then forms such fluid into an annular rotating band of pressurized fluid. The radial thickness of the annular band of trapped fluid varies around the orbit indicating a significant variation of pressure at two different sectors of the orbit. Specifically, the fluid pressure is greatest at the portion of the orbit at which the cylinders 38 are moving radially inward and therefore are also moving closer together. Consequently, the trapped fluid tends to be squeezed between the converging cylinders. As the discharge collector groove 72 communicates only with those of the discharge passages 71 which are at this relatively high pressure sector of the orbit, the scavenging means 65 of the present invention effectively limits the discharge of fluid to the relatively high pressure portion of the orbit. Internal recirculation of such fluid from the high pressure sector back to the lower pressure sector of the orbit is avoided and thus the previously described adverse effects of internal recirculation, such as power losses, are also avoided.

When the device 11 of FIGS. 1 and 2 is operated as a motor, pressurized working fluid from a suitable source is supplied to the first or inlet port 19 while fluid is discharged from the second or outlet port 23. To initiate operation of the motor, race 53 is shifted away from the zero displacement position, at which it is centered on rotational axis 54, a selected distance towards the maximum displacement position as defined by maximum displacement center 56, the degree of such shifting of the race being selected to control the motor output speed and torque. Through groove 47 pressurized fluid from the inlet port 19 enters those of the piston spokes 28 and cylinders 38 which are situated at the upper half of the cylinder orbit as viewed in FIGS. 1 and 2. The pressurized fluid exerts an outward force on the cylinders 58 which, owing to the eccentric position of race 53, causes the cylinders and pistons and thus rotor 27 and drive shaft 29 to turn in a counterclockwise direction as viewed in FIG. 2.

At the lower half of the cylinder orbit as viewed in FIG. 2, the eccentric position of the race 53 forces the cylinders 38 radially inwardly and causes the working fluid to be discharged through the associated piston spokes 28 and the arcuate groove 49 of pintle 26. Thus the cylinders 38 converge in the lower half of the orbit as viewed in FIG. 2 creating a relatively high pressure condition at that portion of the orbit in essentially the same manner as occurs when the device 11 is operated as a pump. The scavenging means 65 operates to release accumulated leakage and cooling fluid from the cylinder orbit chamber 57, without the adverse effects of internal recirculation, in the manner described above with reference to operation of the device 11 as a pump.

In the operation of the device 11*a* with the modifications depicted in FIG. 3, the scavenging means 65*a* enables operation as a pump in which overcenter displacement changes may be made for the purpose of reversing the flow of working fluid through the device while the direction of rotation of the drive shaft 29*a* remains unidirectional at all times. The scavenging action occurs through the first collector groove 72*a* at times when the race 53*a* has been shifted from the zero displacement position defined by rotational axis 54 towards the first displacement center 56. Under this condition, the discharge passages 71*a* of the race 53*a* communicate with the first collector groove 72*a* but do not communicate with the second collector groove 77*a* owing to the eccentric position of the orbit 78 at that time. Thus discharge of accumulated fluid through the scavenging means 68*a* again occurs only at that portion of the orbit where the pressure of such fluid is highest due to cylinder convergence at that portion of the orbit.

If the race 53*a* is then shifted overcenter so that it is centered on a selected point between the rotational axis 54 and the second or reverse maximum displacement center 74, the discharge passages 71*a* are now situated along a shifted orbital path 81 at which such passages communicate with the second collector groove 77*a* but not the first collector groove 72*a*. Thus the scavenging of fluid now occurs at the opposite portion of the cylinder orbit which now constitutes the portion of the orbit at which the pressure of accumulated leakage in cooling fluid is highest.

Thus the modified scavenging means 65*a* of FIG. 3 accomplishes the desired scavenging of accumulated fluid only from the portion of the orbit at which pressure is highest notwithstanding the fact that the high pressure portion of the orbit shifts when overcenter displacement changes are made.

It may be observed in connection with FIG. 3 that when the displacement of the device 11*a* is adjusted to be at or in the vicinity of the zero displacement position, both collector grooves 72*a* and 77*a* may communicate with the discharge passages 71*a*. The adverse effects of internal recirculation from unequal pressures around the cylinder orbit are not significant at the zero displacement position or under conditions of very slight displacement. Cylinder convergence and divergence does not occur at the zero displacement condition and is relatively minor at small displacement settings close to the zero displacement position.

In the operation of the device 11*b* with the modifications depicted in FIG. 4, the scavenging means 65*b* enables operation of the device as a pump in which the direction of fluid flow may be reversed by reversing the direction of rotation of the drive shaft 29*b*, displacement changes for the purpose of varying the rate at which fluid is pumped being made in one direction only from the zero displacement position. In particular, the race 53*b* may be shifted from the zero displacement position at which it is centered on the rotational axis 54 towards the first maximum displacement center 56.

Under conditions where the drive shaft 29*b* is being driven in a counterclockwise direction as viewed in FIG. 4 and race 53*b* has been shifted at least partially out of the zero displacement position towards the maximum displacement position 56, cylinder convergence occurs at the lower sector of the orbit 78*b* as viewed in FIG. 4 and the maximum rate of convergence and therefore the highest pressure within the accumulated leakage and cooling fluid occurs along that portion of the lower sector at which the first collector groove 72*b* is in communication with the discharge passages 71*b* of the race. Cylinder divergence occurs at the upper half of the orbit 78*b* as viewed in FIG. 4 and thus a substantially lower pressure is present at the discharge passages 71*b* which are communicating with the second collector groove 77*b*. Under the above described conditions the discharge of accumulated leakage and cooling fluid occurs through the first collector groove 72*b* and is again confined to a relatively high pressure portion of the orbit 78*b*.

If the direction of rotation of the drive shaft 29*b* is then reversed to reverse the direction in which fluid is being pumped through the device 11*b*, the rotational motion of the cylinders is reversed and the zone of maximum cylinder convergence and therefore the zone of highest pressure in the accumulated leakage and cooling fluid is now at the portion of the orbit 78*b* at which the discharge passages 71*b* communicate with the second collector groove 77*b*. The discharge of the accumulated fluid now occurs through the second collector groove 77*b*. Thus the objective of discharging accumulated leakage and cooling fluid from only a limited relatively high pressure portion of the cylinder orbit 78*b* continues to be realized notwithstanding the fact that the higher pressure portion of the orbit shifted position upon reversal of the direction of rotation of the drive shaft 29*b*.

The device 11*b* of FIG. 4 may also be operated as a motor in which the direction of the output drive through drive shaft 29*b* may be reversed by reversing the direction of flow of pressurized working fluid through the device, the speed of the motor being selectable by selection of the displacement between the zero displacement position defined by rotational axis 54 and the single maximum displacement position 56. Upon reversal of the working fluid flow, the zone of cylinder convergence along the orbit 78*b* changes in essentially the same manner described above with reference to operation of the device 11*b* as a pump. Thus when the drive shaft 29*b* rotation is counterclockwise as viewed in FIG. 4, the scavenging of accumulated fluid occurs through first collector groove 72*b*. When the direction of rotation of the drive shaft 29*b* is reversed by reversing fluid flow direction, the scavenging of fluid occurs through the second collector groove 77*b*.

As will be apparent from the foregoing examples, the configuration of the collector grooves of the scavenging means may be modified in other ways to accommodate to still other operational conditions to which the fluid translating device may be applied.

Other aspects, objects and advantages of this invention can be obtained from a study of the drawings, the disclosure and the appended claims.

We claim:

1. In a radial piston fluid translating device (11, 11*a*, 11*b*) having a rotor (27), a plurality of fluid translating elements (38) carried thereon, race means (44) for forcing radial reciprocation of said elements (38) as said rotor (27) turns and which defines an annular chamber (57) in which said elements (38) orbit and wherein centrifugal force forms accumulated fluid into a rotating annular volume during rotation of said rotor (27) and wherein different portions of said rotating annular volume of fluid exhibit different pressures, the device having a fluid drain path (68, 68*a*, 68*b*) adapted to discharge fluid accumulated *d* in said chamber (57), the improvement comprising:

scavenging means (65) for communicating said drain path (68, 68*a*, 68*b*) with said chamber (57) along a first portion of the element orbit at which the fluid exhibits a first pressure and for blocking communication of said drain path (68, 68*a*, 68*b*) with said chamber (57) along a second portion of said element orbit at which the fluid exhibits a different second pressure.

2. A radial piston fluid translating device (11, 11*a*, 11*b*) as defined in claim 1 wherein said first and second portions of said element orbit are respectively at a relatively high pressure sector of said annular volume of fluid and a relatively low pressure sector thereof.

3. A radial piston fluid translating device (11, 11*a*, 11*b*) as defined in claim 1 wherein said first portion of the element orbit is a portion thereof at which said elements (38) move radially inward relative to the rotational axis (54) of said rotor (27) and said second portion of said element orbit is a portion thereof at which said elements (38) move radially outward relative to said rotational axis (54).

4. A radial piston fluid translating device (11*a*, 11*b*) as defined in claim 1 wherein said first portion of said orbit at which said fluid exhibits said first pressure changes to a different location in said chamber (57) in response to a change in the mode of operation of said device (11*a*, 11*b*) and wherein said scavenging means (68*a*, 68*b*) communicates said drain path (68*a*, 68*b*) with said chamber (57) at said different location therein in response to said change in the mode of operation of said device (11*a*, 11*b*).

5. In a radial piston fluid translating device (11*a*) having a rotor (27), a plurality of fluid translating elements (38) carried thereon, race means (44) for forcing radial reciprocation of said elements (38) as said rotor (27) turns and which defines an annular chamber (57) in which said elements (38) orbit, wherein said race means (44) is selectively shiftable in a first direction orthogonal to the rotational axis (54) of said rotor (27) between a zero displacement position at which the axis (56) of said element orbit is coincident with said axis (54) of said rotor (27) and a first maximum displacement position at which said axes (54, 56) are spaced apart and is also selectively shiftable in a second opposite direction from said zero displacement position to a second maximum displacement position at which said axes (54, 56) are oppositely spaced apart, the device having a fluid drain path (68*a*) adapted to discharge fluid accumulated in said chamber (57), the improvement comprising:

scavenging means (65*a*) for communicating said drain path (68*a*) with said chamber (57) along a first portion of the element orbit and for blocking communication of said drain path (68*a*) with said chamber (57) along a second portion of said element orbit, wherein said scavenging means (65*a*) includes:

first discharge collector means for defining a first collector channel (72*a*) adjacent said first portion of said element orbit and which is communicated with said chamber (57) when said race means (44) is shifted in said first direction, and second discharge collector means for defining a second collector channel (77*a*) adjacent said second portion of said element orbit and which is communicated with said chamber (57) when said race means (44) is shifted in said second direction.

6. A radial piston fluid translating device (11*a*) as defined in claim 5 wherein said first (72*a*) and second (77*a*) collector channels each have a width, measured along radii of said element orbit which is less than the spacing of said axes (54, 56) at said maximum displacement positions.

7. In a radial piston fluid translating device (11, 11*a*, 11*b*) having a rotor (27), a plurality of fluid translating elements (38) carried thereon, race means (44) for forcing radial recriprocation of said elements (38) as said rotor (27) turns and defining an annular chamber (57) in which said elements (38) orbit, wherein said race means (44) includes an annular rotatable race member (58) forming a radially extending wall of said chamber (57), the device having a fluid drain path (68, 68*a*, 68*b*) adapted to discharge fluid which accumulates in said chamber (57), the improvement comprising:

scavenging means (65) for communicating said drain path (68, 68*a*, 68*b*) with said chamber (57) along a first portion of the element orbit and for blocking communication of said drain path (68, 68*a*, 68*b*) with said chamber (57) along a second portion of said element orbit, wherein said scavenging means (65, 65*a*, 65*b*) is defined in part by a plurality of angularly spaced apart discharge passages (71, 71*a*, 71*b*) situated in said race member (58).

8. A radial piston fluid translating device (11, 11*a*, 11*b*) as defined in claim 7 further including nonrotating means (15, 15*a*, 15*b*) for defining a leakage fluid collector groove (72, 72*a*, 72*b*) which extends along said race member (58) at the opposite side thereof from said chamber (57) and which communicates with these said discharge passages (71, 71*a*, 71*b*) which are at said first portion of said element orbit.

9. In a radial piston fluid translating device (11*b*) having a rotor (27), a plurality of fluid translating elements (38) carried thereon, race means (44) for forcing radial reciprocation of said elements (38) as said rotor (27) turns and defining an annular chamber (57) in which said elements (38) orbit, wherein said race means (44) is selectively shiftable in a direction orthogonal to the rotational axis (54) of said rotor (27) between a zero displacement position at which the axes of said element orbit and said rotor (27) are coincident and a maximum displacement position (56) at which said axes are spaced apart, the device having a fluid drain path (68*b*) adapted to discharge fluid accumulated in said chamber (57), the improvement comprising:

scavenging means (65*b*) for communicating said drain path (68*b*) with said chamber (57) along a first portion of the element orbit and for blocking communication of said drain path (68*b*) with said chamber (57) along a second portion of said element orbit, wherein said scavenging means (65*b*) includes:

first discharge collector means for forming a first collector channel (72*b*) along a first sector of said element orbit situated at one side of the plane defined by said spaced apart axes (54, 56), second discharge collector means for forming a second collector channel (77*b*) along a second sector of said element orbit which is situated at the opposite side of said plane defined by said spaced apart axes (54, 56) and means (83, 84) for blocking fluid flow between either one of said first and second collector channels (72*b*, 77*b*) and said drain path (68*b*) when the fluid in said one collector channel (72*b* or 77*b*) is at a lower pressure than the fluid in the other of said collector channels (72*b* or 77*b*).

10. A radial piston fluid translating device (11, 11*a*, 11*b*) comprising:

housing means (12) for defining a housing having first (19) and second (23) working fluid ports and a fluid drain path (68, 68*a*, 68*b*), a rotor (27) support for rotation within said housing means 12 and having a plurality of angularly spaced apart radially extending hollow piston spokes (28), pintle means (26) for communicating a first (19) of said ports with said piston spokes (28) as said piston spokes (28) turn through a first portion of the orbit thereof and for communicating the second (23) of said ports with said piston spokes (28) as said piston spokes turn through a second opposite portion of said orbit thereof, a plurality of radially reciprocal cylinders (38) each being carried on a separate one of said piston spokes (28), annular race means (44) for establishing a cylinder orbit which is eccentric with respect to the axis (54) of said rotor (27) to force radial reciprocation of said cylinders (38) on said spokes (28) as said rotor (27) turns and which forms an annular chamber (57) at the orbital path of said cylinders (38), and scavenging passage means (65, 65*a*, 65*b*) for communicating said chamber (57) with said drain path (68, 68*a*, 68*b*) at a region of said chamber (57) wherein said cylinders (38) move radially inward as said rotor (27) turns and for blocking communication between said drain path (68, 68*a*, 68*b*) and a region of said chamber (57) wherein said cylinders (38) move radially outward as said rotor (27) turns.

11. A radial piston fluid translating device (11, 11*a*, 11*b*) comprising:

a housing (12) having first (19) and second (23) working fluid ports and a fluid drain path (68, 68*a*, 68*b*), a rotor (27) rotatably supported within said housing (12) and having a plurality of angularly spaced apart radially extending hollow piston spokes (28), pintle means (26) for communicating a first (19) of said ports with said piston spokes (28) as said piston spokes (28) turn through a first portion of the orbit thereof and for communicating the second (23) of said ports with said piston spokes (28) as said piston spokes turn through a second opposite portion of said orbit thereof, a plurality of radially reciprocal cylinders (38) each being carried on a separate one of said piston spokes (28), annular race means (44) for establishing a cylinder orbit which is eccentric with respect to the axis (54) of said rotor (27) to force radial reciprocation of said cylinders (38) on said spokes (28) as said rotor (27) turns and forming an annular chamber (57) at the orbital path of said cylinders (38), wherein said race means (44) includes a rotatable member (58) having a surface constituting a radially extending wall of said chamber (57), scavenging passage means (65, 65*a*, 65*b*) for communicating said chamber (57) with said drain path (68, 68*a*, 68*b*) at a region of said chamber (57) wherein said cylinders (38) move radially inward as said rotor (27) turns and for blocking communication between said drain path (68, 68*a*, 68*b*) and a region of said chamber (57) wherein said cylinders (38) move radially outward as said rotor (27) turns and wherein said scavenging passage means (65, 65*a*, 65*b*) is defined in part by a plurality of discharge passages (71, 71*a*, 71*b*) in said member (58), said discharge passages (71, 71*a*, 71*b*) being angularly spaced apart around siad member (58), and further includes means for forming at least one discharge collector channel (72, 72*a*, 72*b*) adjacent said member (58) located to communicate with ones of said discharge passages (71, 71*a*, 71*b*) located at said region of chamber (57) wherein said cylinders (38) move radially inward, said discharge collector channel (72, 72*a*, 72*b*) being communicated with said drain path (68, 68*a*, 68*b*).

* * * * *